US005672854A

United States Patent [19]

Nishio

[11] Patent Number: 5,672,854

[45] Date of Patent: Sep. 30, 1997

[54] SLIDE SWITCH

[75] Inventor: Minoru Nishio, Niwa, Japan

[73] Assignee: Kabushiki Kaisha Tokai-Rika-Denki-Seisakusho, Aichi-ken, Japan

[21] Appl. No.: 690,998

[22] Filed: Aug. 1, 1996

Related U.S. Application Data

[63] Continuation of Ser. No. 240,486, May 10, 1994, abandoned.

[30] Foreign Application Priority Data

May 11, 1993 [JP] Japan ..... 5-024191

[51] Int. Cl.[6] ..... H01H 1/36

[52] U.S. Cl. ..... 200/16 R; 200/5 R; 200/252

[58] Field of Search ..... 200/5 R, 16 R, 200/16 A, 16 C, 16 D, 17 R, 18, 547, 549, 550, 241, 242, 252, 253, 275

[56] References Cited

U.S. PATENT DOCUMENTS 4,342,889 8/1982 Welter ..... 200/144 R 4,720,613 1/1988 Adam ..... 200/146 R 5,049,707 9/1991 Kameya ..... 200/16 D 5,357,069 10/1994 Nishio et al. ..... 200/252

*Primary Examiner*—Cassandra C. Spyrou

*Assistant Examiner*—Michael A. Friedhofer

*Attorney, Agent, or Firm*—Oliff & Berridge

[57] ABSTRACT

A slide switch opening and closing a circuit for supplies electricity to a load by making and breaking contact between a movable contact and a stationary contact. The stationary contact is integrally formed with an arc generating portion for generating an arc when the circuit is opened or closed. The arc generating portion protrudes in the direction of movement of the movable contact and has a width which gradually decreases from its base portion towards its tip portion. The slide switch is capable of preventing the arc generating portion and the movable contact from having a groove due to wear.

16 Claims, 8 Drawing Sheets

D
M
13
18
26b
26
20
26a
23
17a
23
22
17
20
16
25b
20
25
15
22
23
23
24
15a
25a
21
20
14
11
12
A
C

SLIDE SWITCH

This is a continuation of application Ser. No. 08/240,486 filed May 10, 1994, now abandoned.

BACKGROUND OF THE INVENTION

1. Field of the Invention

The present invention relates to a slide switch in which a movable contact slides to make and break contact with a stationary contact so that a circuit for supplying electricity to a load is opened and closed.

2. Description of the Related Art

Among various slide switches, there is a so-called tandem-type (dual-type) switch which is provided with two stationary contact groups each including a plurality of fixed contacts, and a pair of movable contacts each being slidable with respect to the stationary contact groups. A circuit for supplying electricity to a load is opened or closed by simultaneously sliding the two movable contacts. The status of an electric power supply (the direction of current) is changed in accordance with the direction of slide movement of the movable contacts.

The inventors of the present invention have proposed a tandem type switch having a structure shown in FIG. 8. In this switch, a specific stationary contact 1 is formed with a hole as an insulating section 2 for generating arcs. Receiving sections 3 made of a synthetic resin having an insulating capability are provided on both transverse sides of the insulating section 2. When a contact portion 4*a* of a movable contact 4 is slid in the direction indicated by arrow A or in the direction opposite to the direction indicated by arrow A, within a region on the stationary contact 1, the circuit for supplying electricity to a load is opened or closed. At this time, an arc is made to generate between an arc generating portion 1*a* of the stationary contact 1 adjacent to the insulating section 2 and the contact portion 4*a* of the movable contact 4.

In such a switch, even when carbide is produced due to the arc, the production of carbide occurs only within the specific stationary contact 1. Further, the produced carbide is caught by the insulating section 2 because the insulating section 2 is a hole. Accordingly, the switch has an advantage in that it prevents the insulation between the stationary contacts of different polarities from being deteriorated due to carbide.

However, in slide switches, stationary contacts and movable contacts are gradually worn away if arcs are generated between them.

In a slide switch having the aforementioned structure, an arc is generated in a fixed region between the arc generating portion 1*a* of the stationary contact 1 and the contact portion 4*a* of the movable contact 4 when the electric circuit of the load is opened or closed. Therefore, after increasing use, the arc generating portion 1*a* of the stationary contact 1 Is partially worn away such that a groove 5 having a width equal to the width of the contact portion 4*a* of the movable contact 4 is formed in the arc generating portion 1*a*, as shown in FIG. 9.

If such a groove 5 is formed, carbide produced by arcs, powdery grindings produced by wear and the like accumulate in the groove 5. When the carbide, powdery grindings produced by wear and the like accumulate, resistance of contact between the stationary contact 1 and the contact portion 4*a* of the movable contact 4 may be increased.

In a case in which the width of the contact portion 4*a* of the movable contact 4 is greater than the width of the arc generating portion 1*a*, the contact portion 4*a* is partially worn away instead of the arc generating portion and a groove is formed therein, which also causes the problem of accumulating of the carbide, powdery grindings produced by wear and the like.

SUMMARY OF THE INVENTION

An object of the present invention is to provide an improved slide switch which is provided with a stationary contact having an arc generating portion, and which is capable of mostly preventing the increase of resistance of contact between the stationary contact and a movable contact.

A slide switch according to the present invention includes a stationary contact and a movable contact slidable with respect to the stationary contact so as to open and close an electric circuit connected to a load. The stationary contact is integrally formed with an arc generating portion so as to generate an arc between the arc generating portion and the movable contact when the electric circuit is opened or closed. The arc portion protrudes in the direction of movement of the movable contact, and its width gradually decreases from its base portion towards its tip.

The generation of arcs between the arc generating portion of the stationary contact and the movable contact initially occurs at a location near the tip of the arc generating portion side, but the location moves toward the base portion as the switch is repeatedly used.

Since the arc generating portion has a shape such that its width decreases towards its tip portion, such as a triangular shape, the width of the region at which arcs are generated gradually becomes wider as the region moves toward the base portion. Accordingly, wear due to arcs uniformly occurs in the lateral or transverse direction of the arc generating portion and proceeds from the tip portion to the base portion. Therefore, a groove, as is formed in conventional slide switches, is not formed in the arc generating portion. Since the width of the region on the movable contact in which arcs are generated gradually increases as the width of the region on the arc generating portion increases, a groove is not formed on the movable contact.

According to the present invention, the arc generating portion of the stationary contact is formed such that its width gradually decreases towards its tip. With this shape, the arc generating portion and the movable contact which contacts the arc generating portion are prevented from having grooves due to wear. Therefore, the slide switch according to the present invention has an advantage in that it can effectively prevent the increase of resistance of contact between the stationary contact and the movable contact.

DETAILED DESCRIPTION OF THE PREFERRED EMBODIMENT

An embodiment in which the present invention is applied to a switch for a window regulator of a vehicle will now be described with reference to FIG. 1 through FIG. 7.

Figure 1:
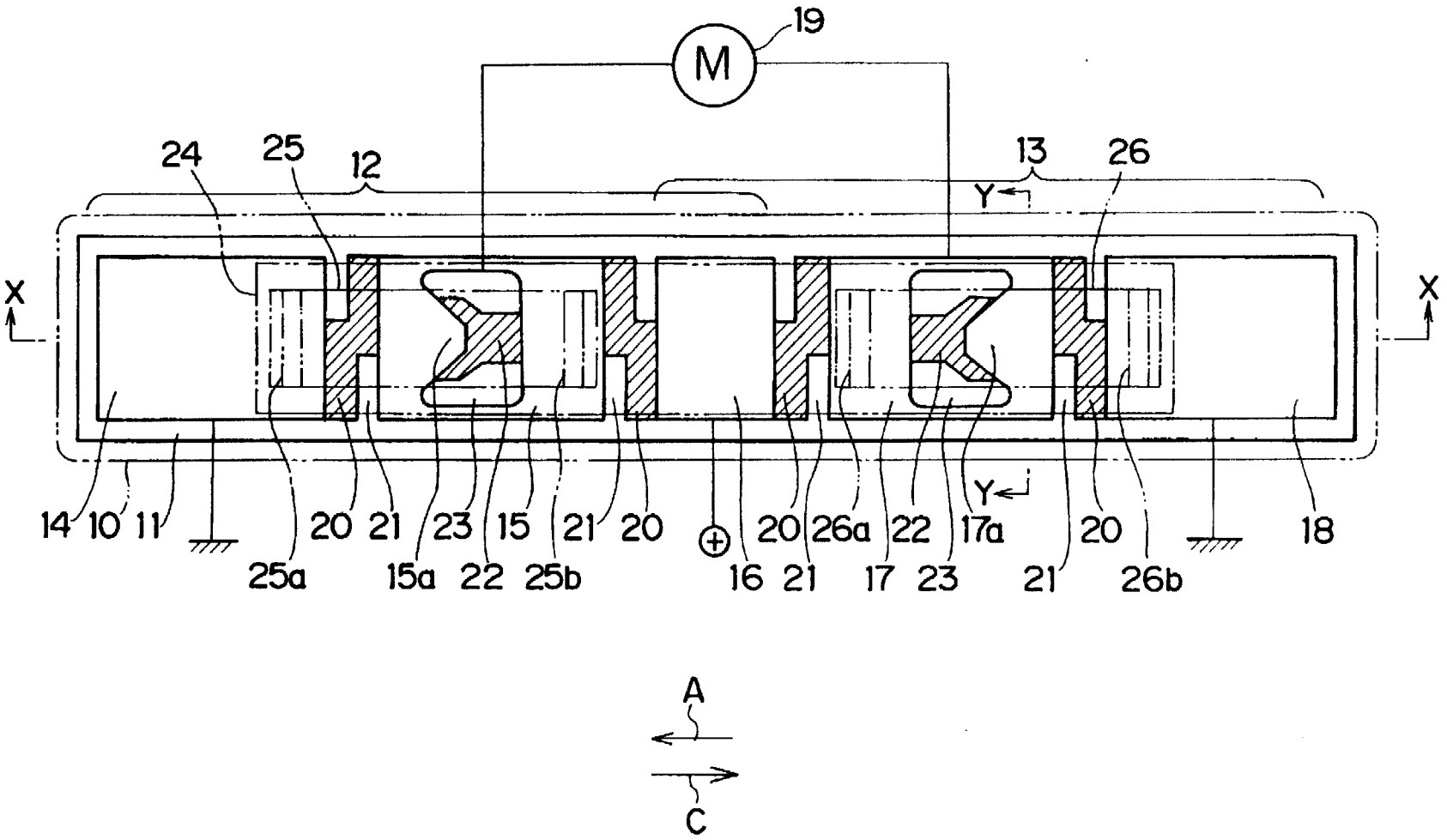
FIG. 1 is a plan view schematically showing a slide switch according to an embodiment of the present invention.
Figure 2:
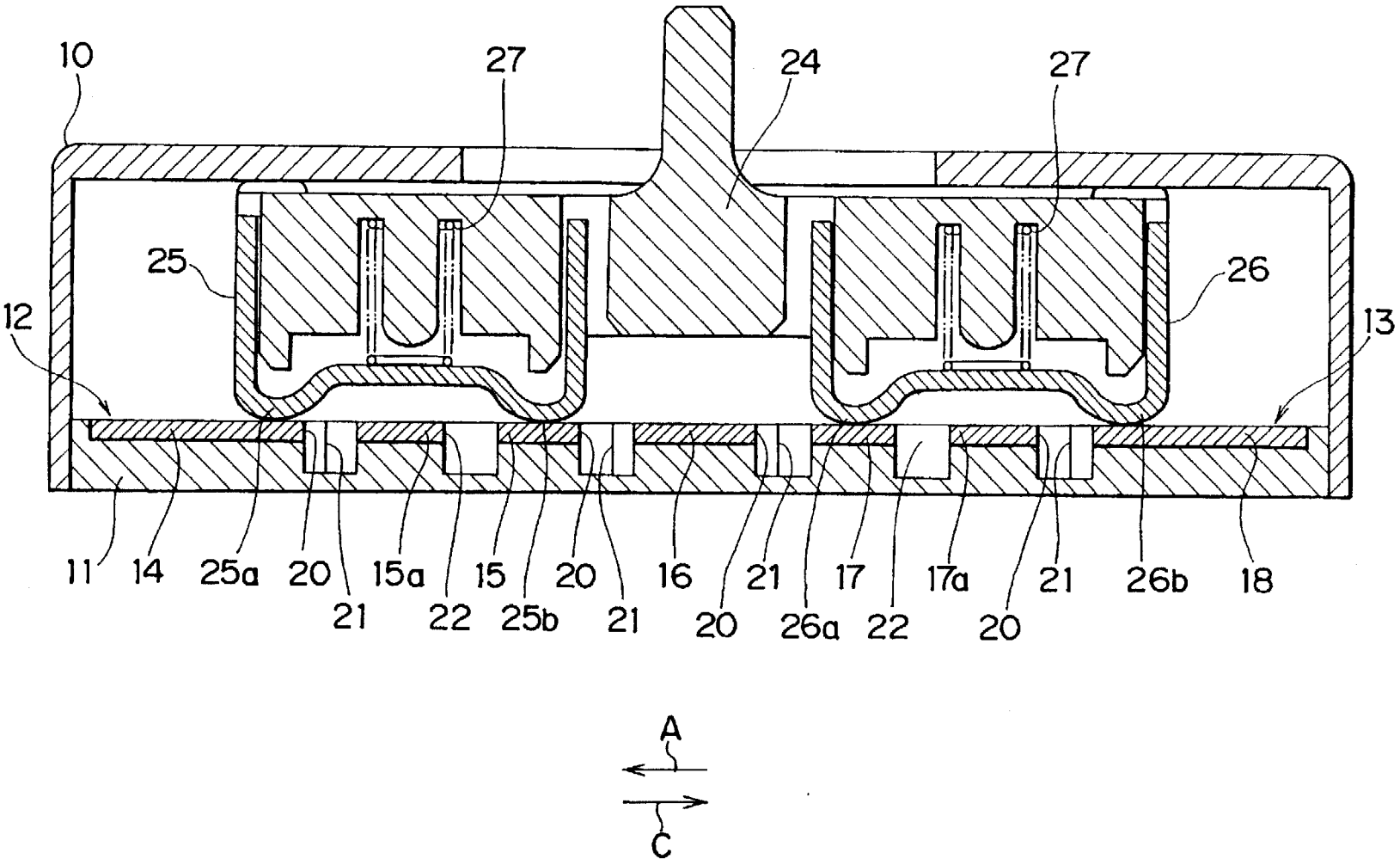
FIG. 2 is a sectional view taking along line X—X in FIG. 1.
Figure 3:
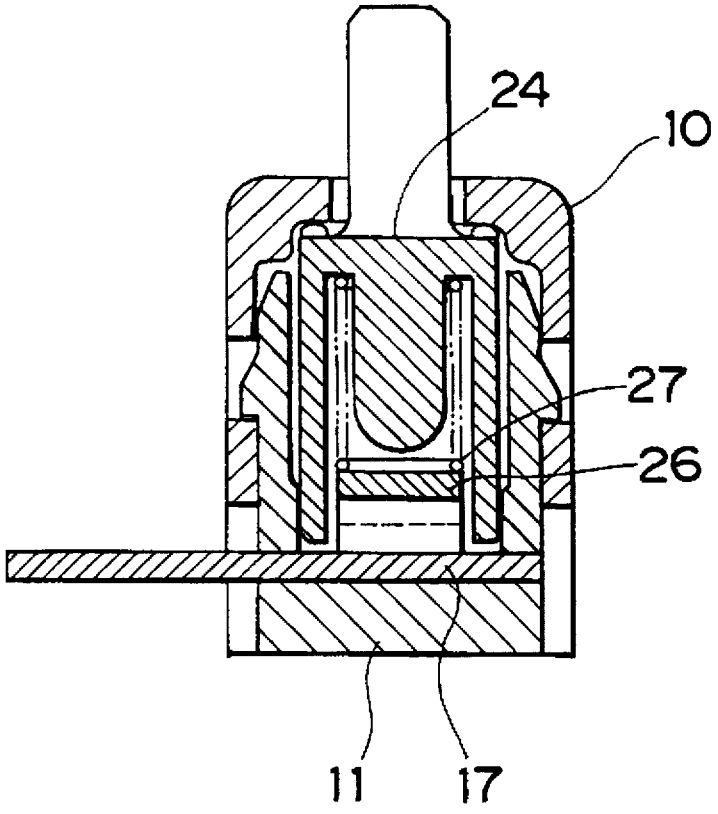
FIG. 3 is a sectional view taking along line Y—Y in FIG. 1.

In FIG. 1 through FIG. 3, a substrate 11 is disposed in a switch case 10 and is made of a plastic or synthetic resin having an insulating capability. A first stationary contact group 12 and a second stationary contact group 13 are linearly arranged on the substrate 11.

The first stationary contact group 12 includes, from left to right in FIG. 1, a first negative stationary contact 14 which is connected to a negative terminal of a power supply source via a ground connection, a first intermediate stationary contact 15, and a common positive stationary contact 16 which is connected to a positive terminal of the power supply source. The second stationary contact group 13 includes, from left to right in FIG. 1, the above-described common positive stationary contact 16, a second intermediate stationary contact 17, and a second negative stationary contact 18 which is connected to the negative terminal of the power supply source via the ground connection. The common positive stationary contact 16 belongs to both the first and second stationary contact groups 12 and 13.

A motor 19 capable of rotating in the forward and reverse directions is connected between the first intermediate contact 15 and the second intermediate contact 17 as a load. Between two adjacent ones of the stationary contacts 14, 15, 16, 17 and 18, there is provided a hole or depression acting as an insulating space 20 (illustrated by hatching in FIG. 1 for better understanding). Further, two guide portions 21 made of an insulating material are provided in each insulating space 20 such that their upper surfaces are flush with corresponding stationary contacts. These guide portions 21 are integral with the substrate 11.

Further, of the stationary contacts 14 through 18, the first and second intermediate stationary contacts 15 and 17 are provided with holes which are formed within the regions on the contacts 15 and 17 and which act as an insulating section 22. The insulating sections 22 include recesses in contacts 15 and 17, and boundary portions are included on the insulating sections 22. The boundary portions on the insulating sections have boundaries in common with boundary portions of the arc generating portions 15*a*, 17*a* of first and second intermediate stationary contacts 15 and 17 respectively and the boundaries are located along the moving direction of movable contacts 24, 26 as illustrated by hatching in FIG. 1 for better understanding. Further, two guide portions 23 made of an insulating material are provided on both transverse sides (above and below as viewed in FIG. 1) of each insulating section 22 such that their upper surfaces are flush with a corresponding stationary contact. These guide portions 23 are integral with the substrate 11, similar to the above-described guide portions 21.

Figure 4:
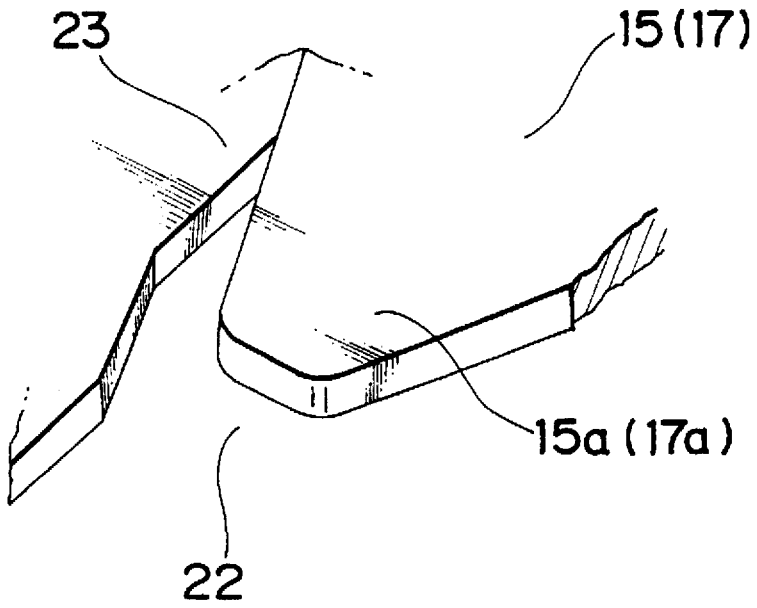
FIG 4 is a perspective view of the arc generating portion.

The first and second intermediate stationary contacts 15 and 17 are formed with the arc generation portions 15*a* and 17*a* at locations adjacent to the above-described insulating sections 22. Each of these arc generating portions 15*a* and 17*a* has a triangular shape the width of which gradually decreases towards its tip as shown in FIG. 4.

Inside the switch case 10, a contact holder 24 is provided on the substrate 11 so as to slide in the direction in which the first and second stationary contact groups 12 and 13 extend. The contact holder 24 is provided with the first movable contact 25 which slides on the first stationary contact group 12, and the second movable contact 26 which slides on the second stationary contact group 13. The first movable contact 25 has two contact portions 25*a* and 25*b* while the second movable contact 26 has two contact portions 26*a* and 26*b*. These contact portions 25*a*, 25*b*, 26*a* and 26*b* are urged by springs 27 to contact the substrate 11.

Figure 5:
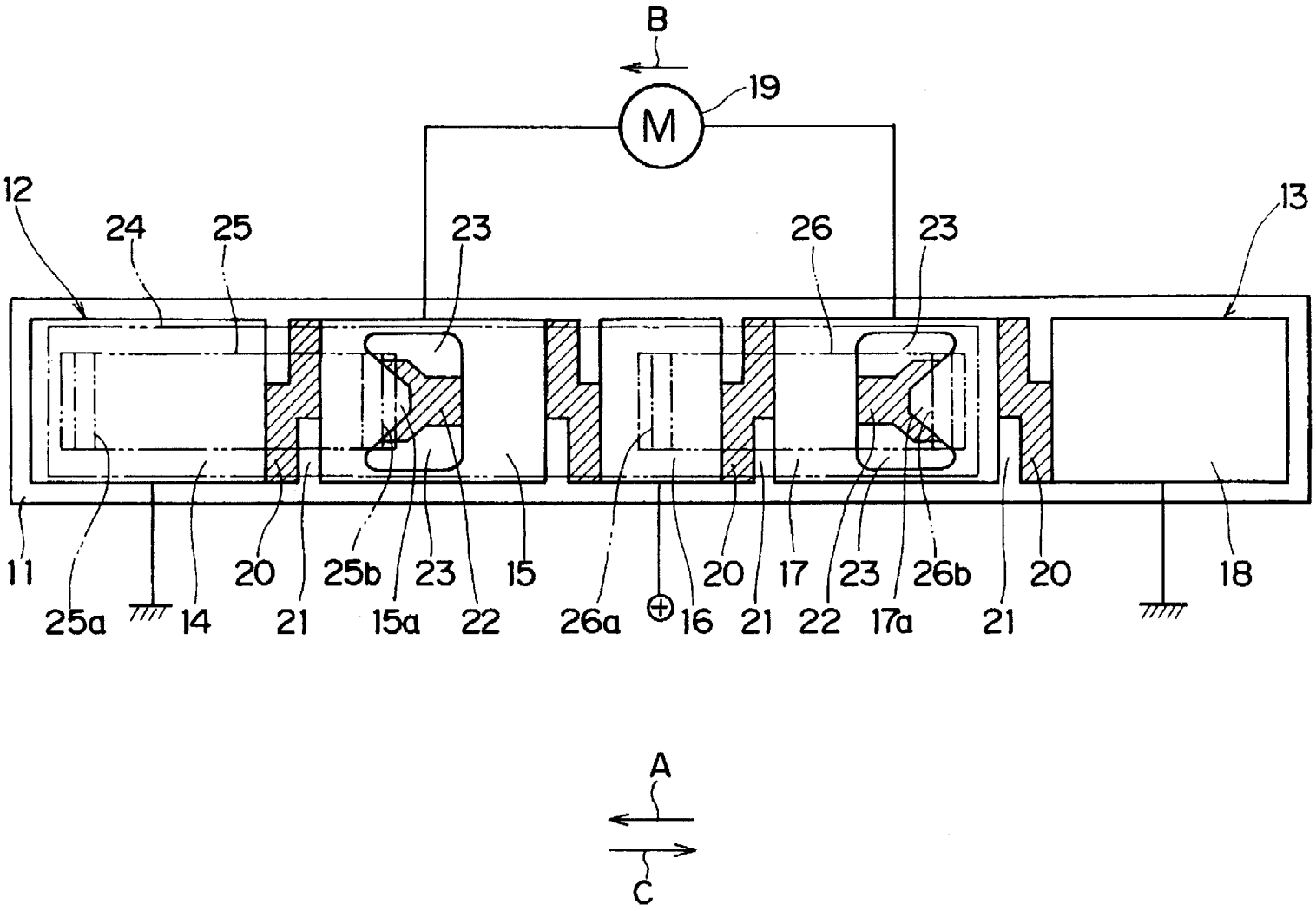
FIG. 5 is a view, corresponding to FIG. 1, in a state in which the contact holder is located at a first operating position.
Figure 6:
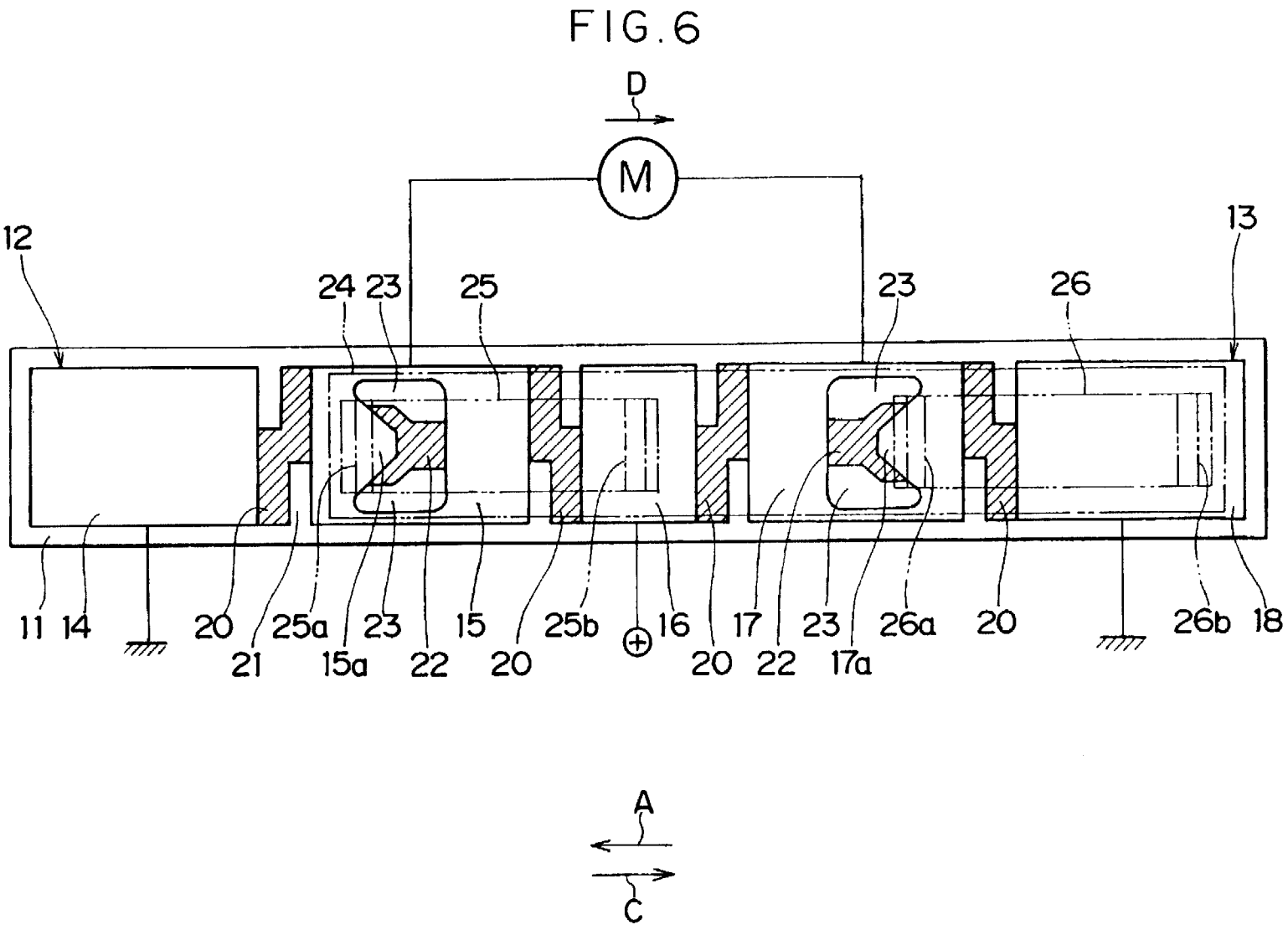
FIG. 6 is a view, corresponding to FIG. 1, in a state in which the contact holder is located at a second operating position.

In this case, the contact holder 24 is moved by the operation of an unillustrated switch knob between a first operating position shown in FIG. 5 and a second operating position shown in FIG. 6. When the operation of the switch knob is released, the contact holder 24 is automatically returned to the neutral position shown in FIG. 1.

The operation of the aforementioned slide switch will now be described.

In the state in which the contact holder 24 is located at the neutral position shown in FIG. 1, the contact portion 25*a* on the left side of the first movable contact 25 is in contact with the first negative stationary contact 14 while the contact portion 25*b* on the right side is in contact with the first intermediate stationary contact 15. The contact portion 26*a* on the left side of the second movable contact 26 is in contact with the second intermediate stationary contact 17 while the contact portion 26*b* on the right side is in contact with the second negative stationary contact 18. In this state, electricity is not supplied to the motor 19.

When the contact holder 24 is slid in the direction of arrow A (to the left as viewed in FIG. 1) by the operation of the unillustrated switch knob and is located at the first operating position as shown in FIG. 5, the left contact portion 25*a* of the first movable contact 25 slides on the first negative stationary contact 14 while maintaining contact therewith. The right contact portion 25*b* of the first movable contact 25 temporarily separates from the first intermediate stationary contact 15 so as to pass through the insulating section 22, and then contacts the arc generating portion 15*a* of the first intermediate stationary contact 15. Meanwhile, the left contact portion 26*a* of the second movable contact 26 moves from the second intermediate stationary contact 17 to the common positive stationary contact 16, passing through the insulating space 20, so that the contact portion 26*a* contacts the common positive stationary contact 16. The right contact portion 26*b* of the second movable contact 26 moves from the second negative stationary contact 18 to the second intermediate stationary contact 17, passing through the insulating space 20, so that the contact portion 26*b* contacts the second intermediate stationary contact 17.

In the state shown in FIG. 5 in which the contact holder 24 is located at the first operating position, the circuit for supplying electricity to the motor 19 is closed through the common positive stationary contact 16, the second movable contact 26, the second intermediate stationary contact 17, the motor 19, the first intermediate stationary contact 15, the first movable contact 25, and the first negative stationary contact 14, so that current flows through the motor 19 in the direction indicated by arrow B. Accordingly, the motor 19 rotates in the forward direction so as to raise an unillustrated window glass.

When the contact holder 24 is slid in the direction of arrow C (to the right as viewed in FIG. 1) by the operation of the unillustrated switch knob and is located at the second operating position as shown in FIG. 6, the left contact portion 25a of the first movable contact 25 moves from the first negative stationary contact 14 to the first intermediate stationary contact 15, passing through the insulating space 20, so that the contact portion 25a contacts the first intermediate stationary contact 15. The right contact portion 25b of the first movable contact 25 moves from the first intermediate stationary contact 15 to the common positive stationary contact 16, passing through the insulating space 20, so that the contact portion 25b contacts the common positive stationary contact 16. Meanwhile, the left contact portion 26a of the second movable contact 26 temporarily separates from the second intermediate stationary contact 17 to pass through the insulating section 22, and then contacts the arc generating portion 17a of the second intermediate stationary contact 17. The right contact portion 26b of the second movable contact 26 slides on the second negative stationary contact 18 while maintaining contact therewith.

In the state shown in FIG. 6 in which the contact holder 24 is located at the second operating position, the circuit for supplying electricity to the motor 19 is closed via the common positive stationary contact 16, the first movable contact 25, the first intermediate stationary contact 15, the motor 19, the second intermediate stationary contact 17, the second movable contact 26 and the second negative stationary contact 18, so that current flows through the motor 19 in the direction indicated by arrow D. Accordingly, the motor 19 rotates in the reverse direction so as to lower the unillustrated window glass.

When the operation of the switch knob is released in the state in which the contact holder 24 is in the first operating position or the second operating position, the contact holder 24 automatically moves back to the neutral position shown in FIG. 1.

In the case in which the contact holder 24 is slid from the neutral position shown in FIG. 1 to the first operating position shown in FIG. 5, the right contact portion 25b of the first movable contact 25 temporarily separates from the first intermediate stationary contact 15 while passing through the insulating section 22. Subsequently, the right contact portion 25b contacts the arc generating portion 15a of the first intermediate stationary contact 15 after the left contact portion 26a of the second movable contact 26 has contacted the common positive stationary contact 16. At the moment the contact portion 25b of the first movable contact 25 engages the arc generating portion 15a, an arc is generated therebetween.

In the case in which the contact holder 24 is slid from the first operating position shown in FIG. 5 to the neutral position shown in FIG. 1, the right contact portion 25b of the first movable contact 25 leaves the arc generating portion 15a of the first intermediate stationary contact 15 and enters the insulating section 22 before the left contact portion 26a of the second movable contact 26 leaves the common stationary contact 16. At the moment when the contact portion 25b of the first movable contact 25 leaves the arc generating portion 15a, an arc is generated therebetween.

In the case in which the contact holder 24 is slid from the neutral position shown in FIG. 1 to the second operating position shown in FIG. 6, the left contact portion 26a of the second movable contact 26 temporarily separates from the second intermediate stationary contact 17 while passing through the insulating section 22. Subsequently, the left contact portion 26a contacts the arc generating portion 17a of the second intermediate stationary contact 17 after the right contact portion 25b of the first movable contact 25 has contacted the common positive stationary contact 16. At the moment the contact portion 26b of the second movable contact 26 engages the arc generating portion 17a, an arc is generated therebetween.

In the case in which the contact holder 24 is slid from the second operating position shown in FIG. 6 to the neutral position shown in FIG. 1, the left contact portion 26a of the second movable contact 26 separates from the arc generating portion 17a of the second intermediate stationary contact 17 and enters the insulating section 22 before the right contact portion 25b of the first movable contact 25 separates from the common stationary contact 16. At the moment when the contact portion 26b of the second movable contact 26 separates from the arc generating portion 17a, an arc is generated therebetween.

In the above-described embodiment, the generation of arcs between the arc generating portions 15a and 17a of the first and second intermediate stationary contacts 15 and 17 and the first and second movable contacts 25 and 26 initially occurs at locations near the tips of the arc generating portions 15a and 17a, but the locations move toward their base portions as the switch is increasingly operated.

Figure 7:
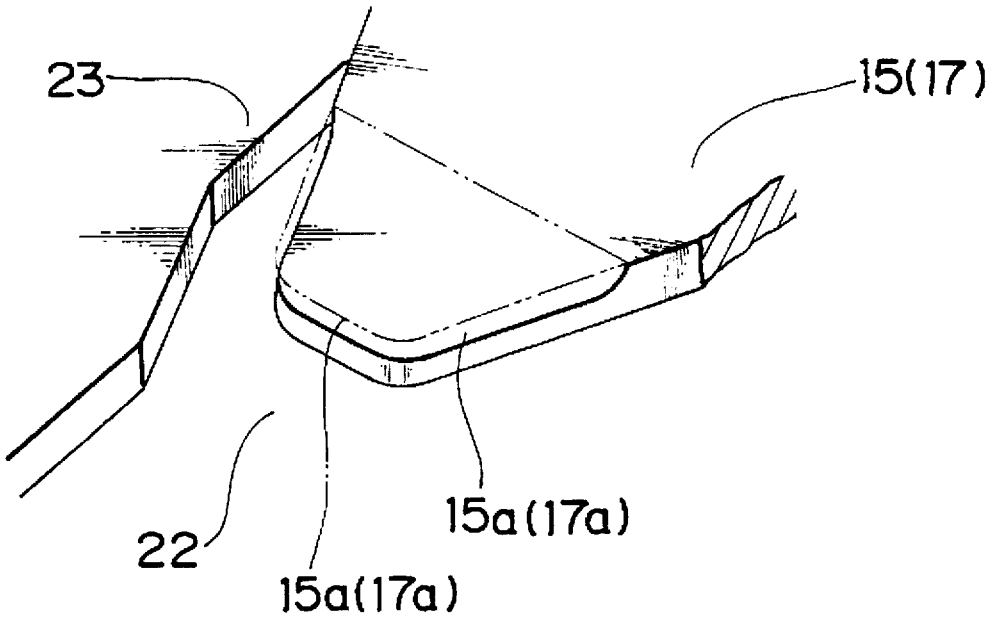
FIG. 7 is a perspective view of the arc generating portion after being worn out.
Figure 8:
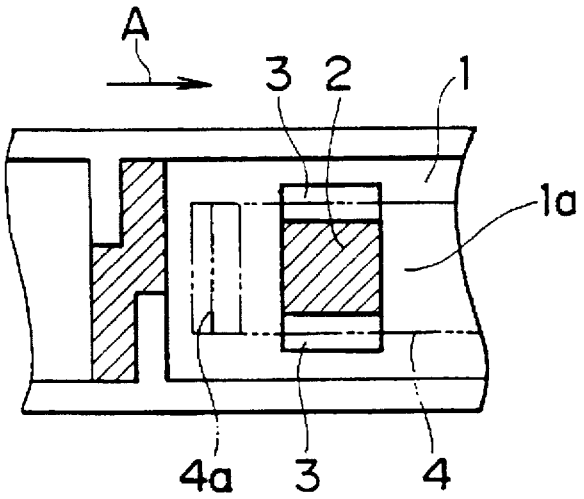
FIG. 8 PRIOR ART
FIG. 8 is a plan view of a stationary contact of a conventional slide switch.
Figure 9:
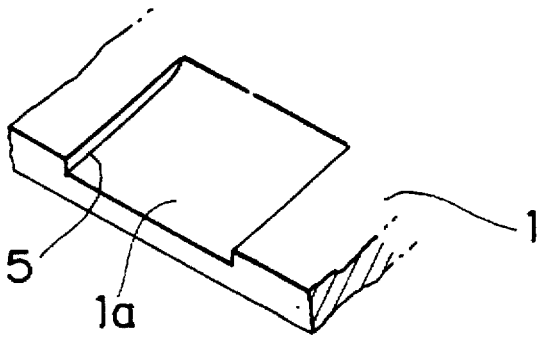
FIG. 9 PRIOR ART
FIG.9 is a perspective view of the arc generating portion of the conventional slide switch after being worn out.

Since each of the arc generating portions 15a and 17a is formed in a triangle shape such that its width gradually decreases from its base portion towards its tip, the width of the region at which arcs are generated gradually becomes wider as the region moves toward its base portion. Accordingly, the wear on each of the arc generating portions 15a and 17a caused by arcs uniformly occurs in the transverse direction of each arc generating portion and proceeds from the tip portion to the base portion; as shown in FIG. 7. A groove, as is formed in conventional slide switches, is not formed in the arc generating portions. Therefore, carbide produced by arcs, and powdery grindings produced by wear do not accumulate on the arc generating portions 15a and 17a. Further, since the widths of the regions on the contact portions 25b and 26a of the movable contacts 25 and 26 in which arcs generate gradually increase as the widths of the regions on the arc generating portions 15a and 17a increase, a groove is not formed in the contact portions 25a and 26a of the movable contacts 25 and 26.

According to the present embodiment, the arc generating portions 15a and 17a of the stationary contacts 15 and 17 and the contact portions 25a and 26a of the movable contacts 25 and 26 are not formed with a groove due to wear even after increasing use. This provides optimum prevention of the increase of resistance of contact between them.

Although the arc generating portions 15a and 17a are formed in the first and second intermediate stationary contacts 15 and 17 in the above-described embodiment, the arc generating portions may be formed in other stationary contacts. Further, the positions of the arc generating portions are not limited to locations within the stationary contacts (within the regions of the stationary contacts), and may be formed at edges of the stationary contacts (which face the insulating space sections between two stationary contacts). The present invention is not limited to the above-described tandem-type slide switch and can be applied to ordinary single-type slide switches. Further, the arc generating portions 15a and 17b may be protrusions having a curved edge such as a semicircular shape or shapes such as an isosceles triangular shape, trapezoidal shape, and isosceles trapezoidal shape.

What is claimed is:

1. A slide switch for opening and closing a circuit for supplying electricity to a load comprising:

a movable contact which is slidable; and a stationary contact which said movable contact contacts and separates therefrom, said stationary contact being integrally formed with an arc generating portion for generating arc between said arc generating portion and said movable contact when said circuit is opened or closed and including an insulating section, said insulating section including a recess in said stationary contact, said arc generating portion protruding in a direction in which said movable contact moves and defining a base portion near a protrusion from the stationary contact and a tip portion opposite from the base, said arc generating portion having a width which gradually decreases from its base portion towards its tip portion, wherein said recess includes a substantially first portion, which is substantially complementary in shape to said arc generating portion.

2. A slide switch according to claim 1, wherein said arc generating portion has a substantially triangular shape, said triangular shape having a base, the base portion of said arc generating portion corresponding to the base of the triangular shape.

3. A slide switch according to claim 2, wherein said arc generating portion has an isosceles triangular shape, said isosceles triangular shape having an apex and first and second sides of equal length, the tip portion of said arc generating portion corresponding to the apex between said first and said second equal sides of the isosceles triangular shape.

4. A slide switch according to claim 1, wherein said arc generating portion has a trapezoidal shape, said trapezoidal shape having an upper side, the tip portion of said arc generating portion forming the upper side of the trapezoidal shape.

5. A slide switch according to claim 4, wherein said arc generating portion has an isosceles trapezoidal shape.

6. A slide switch according to claim 1, wherein said arc generating portion is a protrusion having a curved edge shape.

7. The slide switch of claim 1, wherein said first portion and said arc generating portion have a common boundary located along the moving direction of said movable contact.

8. The slide switch of claim 1, wherein said recess includes a second portion, rectangular in shape, extended from said first portion of said recess in the direction in which said movable contact moves.

9. A slide switch for opening and closing a circuit for supplying electricity to a load comprising:

a first movable contact which is provided with first and second contact portions and which is slidable;

a second movable contact which is provided with third and fourth contact portions and which is slid together with said first movable contact;

a first negative stationary contact which said first contact portion contacts and separates therefrom;

a first intermediate stationary contact which said first and second contact portions contact and separate therefrom, said first intermediate stationary contact being integrally formed with a first arc generating portion for generating arc between said first arc generating portion and said first movable contact when said circuit is opened or closed and including an insulating section, said insulating section including a recess in said first intermediate stationary contact, wherein said first arc generating portion protrudes in a direction in which said first movable contact moves and defining a base portion near a protrusion from the stationary contact and a tip portion opposite from the base, said arc generating portion has a width which gradually decreases from its base portion towards its tip portion, wherein said recess in said first intermediate stationary contact includes a substantially bounded first portion, which is substantially complementary in shape to said first arc generating portion;

a common positive stationary contact which said second and third contact portion contact and separate therefrom;

a second intermediate stationary contact which said third and fourth contact portions contact and separate therefrom, said second intermediate stationary contact being integrally formed with a second arc generating portion for generating arc between said second arc generating portion and said second movable contact when said circuit is opened or closed and including an insulating section, said insulating section including a recess in said second intermediate stationary contact, wherein said second arc generating portion protrudes in a direction in which said second movable contact moves and defining a base portion near a protrusion from the stationary contact and a tip portion opposite from the base, said arc generating portion has a width which gradually decreases from its base portion towards its tip portion, wherein said recess in said second intermediate stationary contact includes a substantially bounded first portion, which is substantially complementary in shape to said second arc generating portion; and a second negative stationary contact which said fourth contact contacts and separates therefrom.

10. A slide switch according to claim 9, wherein each of said arc generating portions has a substantially triangular shape, said triangular shape having a base, the base portion of each of said arc generating portion corresponding to the base of the triangular shape.

11. A slide switch according to claim 10, wherein each of said arc generating portions has an isosceles triangular shape, said isosceles triangular shape having an apex and first and second sides of equal length, the tip portion of each arc generating portion corresponding to the apex between two equal sides of the isosceles triangular shape.

12. A slide switch according to claim 9, wherein each of said arc generating portions has a trapezoidal shape, said trapezoidal shape having an upper side, the tip portion of each arc generating portion forming the upper side of the trapezoidal shape.

13. A slide switch according to claim 12, wherein each of said arc generating portions has an isosceles trapezoidal shape.

14. A slide switch according to claim 9, wherein each of said arc generating portions is a protrusion having a curved edge shape.

15. The slide switch of claim 9, wherein said first portion of said recess in said first intermediate stationary contact and said first arc generating portion having a common boundary located along the moving direction of said movable contact and said first portion of said recess in said second intermediate stationary contact and said second arc generating portion having a common boundary located along the moving direction of said movable contact.

16. The slide switch of claim 9, wherein said recess in said first intermediate stationary contact includes a second portion, rectangular in shape, extended from said first portion of said recess in said first intermediate stationary contact in the direction in which said first movable contact moves, and said recess in said second intermediate stationary contact includes a second portion, rectangular in shape, extended from said first portion of said recess in said second intermediate stationary contact in the direction in which said second movable contact moves.

* * * * *